United States Patent [19]

Foster

[11] 3,982,286

[45] Sept. 28, 1976

[54] SWIMMING POOL COVER

[76] Inventor: Elton Gordon Foster, 2034 Dryden Road, Houston, Tex. 77025

[22] Filed: Oct. 15, 1974

[21] Appl. No.: 514,754

[52] U.S. Cl. ..... 4/172.14

[51] Int. Cl.[2] ..... E04H 3/19; E04H 3/16; F16L 21/02

[58] Field of Search ..... 4/172.11, 172, 172.12, 4/172.13, 172.14; 254/147, 144, 185, 189; 242/54, 55

[56] References Cited

UNITED STATES PATENTS

| | | | |
|---|---|---|---|
| 2,754,899 | 7/1956 | Karobonik et al. | 4/172.14 |
| 2,898,607 | 8/1959 | McGuire | 4/172.14 |
| 3,019,450 | 2/1962 | Karasiewicz | 4/172.14 |
| 3,094,710 | 6/1963 | Hoke | 4/172.11 |
| 3,096,078 | 7/1963 | Steingass et al. | 254/189 X |
| 3,184,764 | 5/1965 | West | 4/172.12 |
| 3,277,498 | 10/1966 | Kleinbard et al. | 4/172.14 |
| 3,499,174 | 3/1970 | Carey | 4/172.14 |
| 3,501,783 | 3/1970 | Broadman | 4/172.14 |
| 3,747,132 | 7/1973 | Foster | 4/172.14 |

*Primary Examiner*—Henry K. Artis
*Attorney, Agent, or Firm*—Colton & Stone, Inc.

[57] ABSTRACT

A flexible cover is stored in rolled condition on a reel at one end of a swimming pool. Cables extend along the pool sides and over a reversing pulley for attachment to a trolley secured to the free cover end. The cable cover reels are driven at the same rotational rate and a cable slack take-up mechanism is provided for maintaining the cover and the cables free of substantial slack throughout reeling and unreeling movement. Means are provided that operate during reeling movement of the swimming pool cover to allow water accumulated on top thereof to flow off the cover into the swimming pool while retaining debris, such as leaves, twigs and the like on top of the cover for movement out of the swimming pool.

11 Claims, 13 Drawing Figures

SWIMMING POOL COVER

Swimming pool covers which are advanced and retracted by motor operated mechanisms are well known in the prior art. One type swimming pool cover incorporates a spooled cover adjacent one end of the pool, a reversing pulley at the other end of the pool, and suitable cables passing over the reversing pulley and connected at opposite ends to the driving mechanism and the cover. Typical disclosures of this type are found in U.S. Pat. Nos. 2,754,899; 2,958,083; 3,277,498 and 3,426,366. In the typical device of this type the cable reels and the cover reel are driven simultaneously, either by being mounted on the same shaft or by connection through single ratio gearing.

There is a substantial problem with simple drives of this type which is a result of a changing diameter of the cover reel and the cable reels. It will be apparent to those skilled in the art that, at the beginning of cover placement, the cover reel is of larger diameter than the cable reels and the diameter of the cover reel decreases while the diameter of the cable reels increases. When beginning the placement of the swimming pool cover, one revolution of the cover reel pays out a length of cover equal to the circumference of the cover reel while the cable reels retract a length of cable equal to the circumference of the cable reels. Since the cover reel is of substantially larger diameter than the cable reels, the pool cover becomes slack and tends to wind up on the roller in the wrong direction when it should in fact be unwinding. A similar problem occurs at the beginning of cover retraction. This problem and several solutions are disclosed in substantial detail in U.S. Pat. No. 3,747,132 to which reference is made for a more complete description thereof.

It has been learned that the "shock cord" embodiment disclosed in U.S. Pat. No. 3,747,132 is quite satisfactory to maintain the swimming pool cover and cables free of substantial slack if the cover is relatively thin. Since the magnitude of the problem occurring at inception of cover placement is at least partially a function of the difference between the cable reel diameter and the cover reel diameter, it will be seen that the problem becomes more acute as the thickness of the cover material increases. As the cover material thickness is increased, it becomes apparent that the presently available shock cord provides insufficient take-up capacity at some instance in the cycle of cover placement and retraction. In addition, a heavier cover tends to drag on the pool deck during cover placement to a greater degree than a lighter cover. Accordingly greater tension is required to overcome drag friction while retaining the capacity to extend.

Another problem discussed at substantial length in U.S. Pat. No. 3,747,132 is the retraction of the swimming pool cover at a time when water has accumulated on top of the cover. Although the solution disclosed in the U.S. Pat. No. 3,747,132 is quite satisfactory to allow dumping of the rainwater and retraction of the cover, it has been learned that leaves, debris and the like are washed off the cover into the swimming pool by the dumped rainwater. This can, of course, be quite exasperating since one must now clean the pool although the pool may have been clean prior to cover retraction. By this invention, water is dumped off of the swimming pool cover during retraction while leaves, debris and the like are retained on the cover for movement out of the swimming pool and ultimate disposal.

It is an object of this invention to provide a motorized swimming pool cover including improved means for maintaining a cover of substantial thickness free of substantial slack throughout the spooling and unspooling movement thereof.

Another object of the invention is to provide a mechanized swimming pool cover in which the cover and cable reels are simultaneously driven and including an elongate spring for taking up cable slack and thereby allowing differential travel between the cable and the cover.

Another object of the invention is to provide a mechanized swimming pool cover including means for dumping water off the top of the cover during retraction while retaining leaves, debris and the like on the cover.

In summary, one aspect of this invention comprises a swimming pool cover of the type including a reel having a cover spooled thereon; means operatively connected to the cover for spooling and unspooling the same across a swimming pool and including a reel having thereon spoolable cable means operatively connected to the cover, means for simultaneously rotatably driving the cover and cable reels at a predetermined speed of ratio, and means for maintaining the cover and the cable means free of substantial slack adjacent the respective reel thereof throughout spooling and unspooling of movement including a cable slack take-up mechanism comprising a traveling pulley arrangement threadably receiving the cable means and an elongate spring connected to the pulley arrangement for biasing the same in a cable tensioning direction in response to decreased cable tension.

In summary, another aspect of this invention comprises a swimming pool cover of the type including a reel having an impermeable cover spooled thereon; means operatively connected to the cover for spooling and unspooling the same across a swimming pool and including a trolley above the surface of water in the pool for traversing the pool, means for moving the trolley, and attachment means connecting the trolley to the cover; the cover defining a path of movement along the water surface and then upwardly adjacent the edge of the pool; the improvement comprising means for removing accumulated rain water from the top of the cover while retaining debris thereon comprising a permeable section in the impermeable cover adjacent the trolley end thereof; and the attachment means, the attachment means comprising flexible elements having a minimum stretched length sufficient to place the permeable section at water level and a maximum unstretched length insufficient to place the permeable section at water level.

Figure 1:
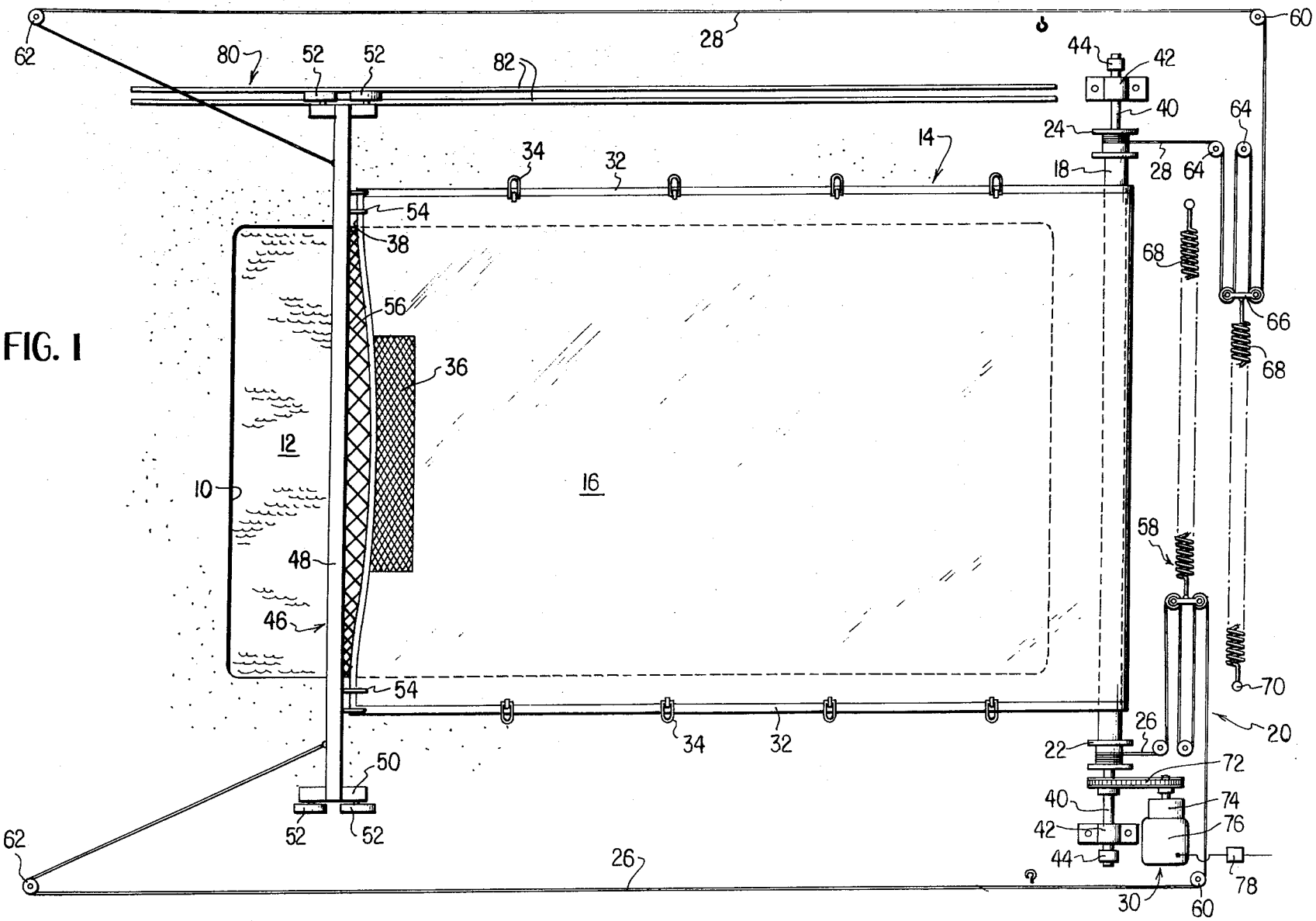
FIG. 1 is a plan view of one embodiment of the invention, certain parts being broken away for clarity of illustration.

Referring to FIG. 1, there is illustrated a swimming pool 10 containing a quantity of water 12 which is partially covered by a motorized swimming pool cover 14 in accordance with this invention. The swimming pool cover 14 comprises as major components a sheet or cover 16, a roller 18 constituting a reel for the sheet 16, means 20 for spooling and unspooling the sheet 16 including cable reels 22, 24 having cables or ropes 26, 28 spooled therearound and driving means 30 for driving the roller 18 and the cables reels 22, 24.

The sheet or cover 16 may be made of any suitable impermeable material, such as polyethylene, vinyl coated nylon or the like. A particularly suitable material comprises a 22 ounce per square yard vinyl coated nylon. Suitable reinforcing strips 32, such as nylon webbing, extend along the lateral sides of the cover 16. If desired, D-rings 34 may be sewed to the cover 16 and webbing 32 to allow the cover 16 to be tied down as desired.

For purposes more fully explained hereinafter, the cover 16 comprises a permeable section 36 adjacent a tape-reinforced free end 38 of the cover 16. The permeable section 36 may comprise a fabric or mesh of any desired texture. As shown best in FIGS. 2 and 4 and as discussed in U.S. Pat. No. 3,747,132, the sheet 16 is reeled onto the top of the roller 18 to allow leaves or other debris to pass over the top of the roller 18 and onto the ground adjacent thereto.

The roller 18 may conveniently be a piece of aluminum tubing. The cable reels 22, 24 may be affixed to the end of the tubing and connected to a pair of oppositely directed stub shafts 40 rotatively received in bearings 42 which are secured in any convenient manner to the pool deck. A thrust collar 44 may be provided on the ends of the shafts 40.

Figure 2:
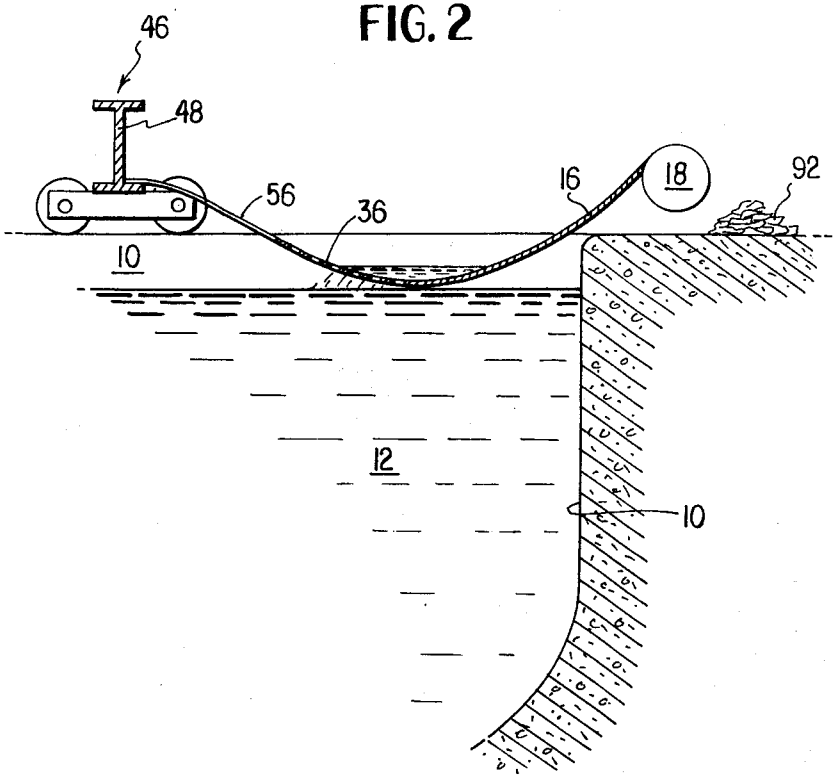
FIG. 2 is a partial longitudinal cross-sectional view of the device of FIG. 1 illustrating rainwater removal from the top of the cover.

The spooling and unspooling means 20 includes a trolley 46 comprised of an I-beam or other structural member 48 spanning the pool 10 and a pair of dollies 50 having wheels 52 for traversing the pool 10. The I-beam 48 is connected to the lateral edges of the cover 16 by a plurality of rigid members 54, such as shackles or the like, while the center section of the cover 16 is connected to the I-beam 48 by a lacing comprised of elastic flexible elements 56 such as shock cord or the like. Since the trolley 46 and the reel 18 are above water level, the cover 16 assumes an upwardly concave configuration when the trolley 26 approaches the reel 18. Accordingly, rain water accumulating on top of the cover 16 becomes concentrated in the low area of the cover 16 during cover retraction as shown in FIG. 2. As disclosed in U.S. Pat. No. 3,747,132, the elastic elements 56 allow the center portion of the cover 16 to move relatively away from the I-beam 48 and approach water level so that the accumulated water may run off of the cover 16. As previously mentioned, on difficulty which may occur in some areas is that leaves, twigs and other debris accumulating on top of the cover 16 tend to flow along with the accumulated rain water back into the swimming pool 10. It is obviously quite desirable to prevent such debris from passing into the swimming pool 10.

As shown best in FIG. 2, the permeable section 36 acts as a filter to separate water running therethrough from debris which is left behind on the cover 16. As water continues to pass through the mesh of the permeable section 36, the weight carried by the cover 16 decreases so that the spooling and unspooling means 20 may wind the cover 16 about the roller 18. Any leaves or debris carried by the cover 16 pass over the roller 18 and accumulates as suggested in FIGS. 2 and 4.

It is highly desirable that the flexible elements 56 be of an appropriate length as discussed in U.S. Pat. No. 3,747,132. As suggested in FIG. 2, the minimum stretched length of the flexible elements 56, i.e. when they are carrying a load such as the accumulated rainwater, is sufficient to place at least the rearward end of the permeable section 36 at approximately water level. In this condition, accumulated rainwater runs through the permeable section 36 into the swimming pool 10. It will be apparent that leaves, debris or the like of greater size than the mesh of the section 36 will be retained on the cover 16. Accordingly, as the cover 16 is completely wound onto the roller 18, such debris accumulates behind the roller 18 as suggested in FIGS. 2 and 4.

It is also desirable that the flexible elements 56 have a maximum unstretched length sufficient to maintain the rear or trailing edge of the permeable section 38 out of the water 12 during placement of the cover 16. Assuming for purposes of illustration that the flexible elements 56 are unloaded but of such a length that the permeable section 36 is at water level, it will be apparent that leftward movement of the cover 16 in FIG. 2 will cause water in the pool 10 to pass through the permeable section 36 onto the top of the cover 16. This is quite disadvantageous since the cover 16 must now be forced through the water requiring mechanisms of uneconomic capacity.

The cables or ropes 26, 28 are disposed on opposite sides of the pool 10 and extend respectively from the reels 22, 24 through slack take-up mechanisms 58, around suitable idler pulleys 60, 62 for connection to the I-beam 48 in any suitable manner. The slack take-up mechanisms 58 are illustrated as each comprising a pair of stationary pulley blocks 64 and a traveling double pulley block arrangement 66 around which the cables 26, 28 are threaded. The central section of the double pulley block arrangement 66 is connected to an elongate tensile helical spring 68 which is fastened at the opposite end 70 to the walkway around the pool 10. It will accordingly be apparent that should tension in the cables 26, 28 decrease, the springs 68 contract to move the double pulley blocks 66 in the direction in which tends to increase tension in the cables 26, 28. By increasing tension in the cables 26, 28 it will be apparent that the cover 16 remains free of substantial slack. Thus, the cover 16 will be wound and unwound from the roller 18 in a substantially uniform fashion as pointed out in U.S. Pat. No. 3,747,132.

The driving means 30 includes a chain drive 72 driven by a gear box 74 which is in turn driven by a suitable motor 76. The motor 76 is preferably a reversing motor controlled by a three-position switch 78. The switch 78 allows placement and retraction of the cover 16 as well as an off position.

It will be apparent to those skilled in the art, the diameter of the cover 16 spooled onto the roller 18 is relative small at the inception of cover retraction while the diameter of the cable spooled on the reels 22, 24 is relatively large. Accordingly, at the inception of cover retraction, one revolution of the chain drive 72 pays out more cable off the reels 22, 24 than is taken up by spooling of the cover 16 onto the roller 18. Unless compensated for, this condition would tend to produce uneven spooling of the cover 16 on the roller 18. However, in accordance with this invention the elongate tensile springs 68 sense the reduction in tension in the cables 26, 28 and contract to maintain tension at approximately the rating of the springs.

At the inception of cover placement, it will be apparent that the diameter of the spooled cover 16 is substantially greater than the diameter of the spooled cables 26, 28. Accordingly, the length of cover 16 paid out from the roller 18 exceeds the length of cable wound onto the reels 22, 24. Unless accommodated, the cover 16 becomes slack adjacent the roller 18 and tends to wind up in the wrong direction about the roller 18. It will be evident, however, that the cables 26, 28 go slack when the cover 16 becomes slack. The springs 68 sense a reduction of tension in the cables 26, 28 and contract so that the tension in the cables 26, 28 and the cover 16 approach the rated capacity of the springs 68.

Since the cover 16 overlaps the edges of the pool 10 and since the roller 18 and trolley 46 are above water level, the cover 16 tends to assume an upwardly concave configuration when viewed in transverse cross-section. There is accordingly a natural tendency of the edges of the cover 16 to roll inwardly toward the center of the cover reel 18 when the cover 16 is being rolled up. It has been found that this tendency can be obviated by rigidly attaching the cover edges to the I-beam 48, as by use of the shackles 54, and maintaining sufficient tension between the I-beam 48 and the cover 16 during all stages of spooling and unspooling the cover 16. Accordingly, the slack take-up mechanism 58 is designed to established substantially uniform tension in the cables 26, 28 and in the cover 16 throughout cover movement. For example, for a swimming pool of 18 feet × 36 feet and a cover of 20 feet × 40 feet, a tensile force of 35–40 lbs in each of the cables 26, 28 is quite satisfactory. With this tension and with the corners of the cover 16 attached fairly rigidly to the I-beam 48, the cover 16 rolls up quite smoothly and uniformly. It will be apparent that a relatively high tension in the cover 16 is quite desirable regardless of the weight thereof since it is difficult for a child to lift the edge of the cover and fall into the swimming pool 10.

At least partially because of the substantial tension in the cover 16, the reinforcement 32 becomes quite desirable. It will be apparent, however, that the provision of the reinforcing webbing 32 increases the thickness of the edges so that, as the cover 16 is spooled onto the roller 18, the diameter of the rolled sides of the cover increases faster than the diameter of the major central portion of the cover 16. Accordingly, as the cover 16 continues to be spooled, a greater tension is exerted on the side edges of the cover. As a result the edges of the cover are kept very tight during spooling and the central cover is relatively more slack.

Although the reinforcing webbing 32 is quite desirable, one potential problem is created. Unless the webbing 32 rolls up uniformly at both ends of the cover reel 18, one end thereof will increase in diameter faster than the other end as the cover is spooled. The end with the greater diameter will then roll up faster and the cover will become skewed as it approaches the reel 18. Accordingly, it may be desirable to provide a guide 80 for one or both of the dollies 50. The guide 80 may conveniently comprise a pair of elongate wooden strips 82 spaced apart to receive the wheels 52 therebetween. To prevent the wheels 52 from climbing the strips 82, the edges of the strips 82 facing the wheels 52 may be lined with a low friction material, such as polyethylene, Teflon, or the like. It will accordingly be apparent that the trolley 46 cannot become skewed relative to the swimming pool 10.

Figure 4:
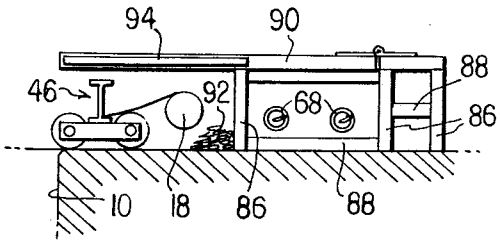
FIG. 4 is a side elevational view of the deck of FIG. 3.
Figure 3:
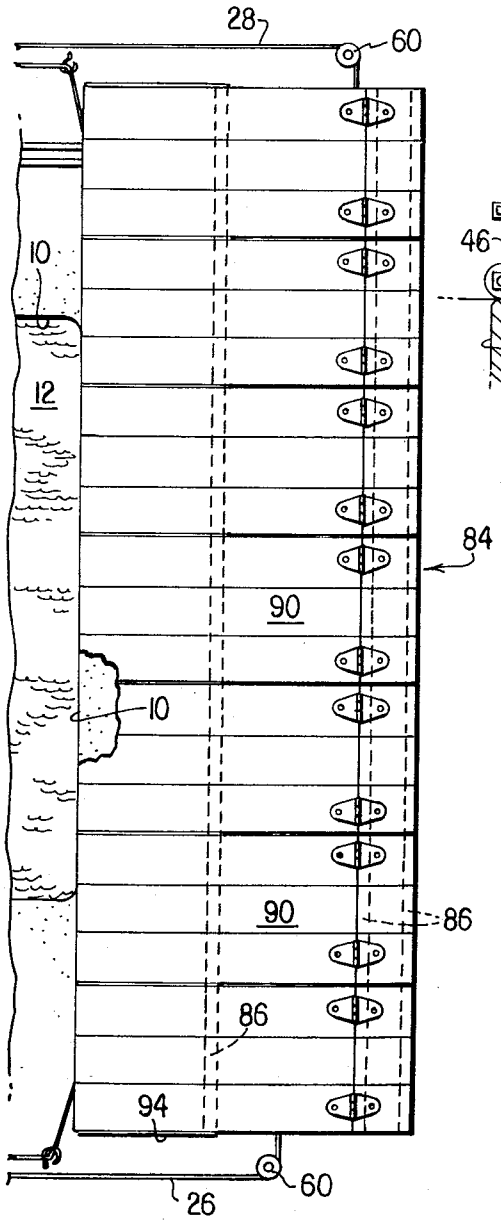
FIG. 3 is a partial plan of view illustrating a deck for enclosing much of the operating mechanism of FIG. 1.

As shown best in FIGS. 3 and 4, there is provided a cover deck 84 at one end of the pool 10 for enclosing much of the operating mechanism illustrated in FIG. 1. The cover deck 84 comprises transverse columns 86 such as a suitable board on edge interconnected by spacers 88 in any suitable manner. The columns 86 and spacers 88 accordingly provide a base or foundation on which is pivotly mounted a plurality of deck sections 90. It will be apparent that the sections 90 may be pivoted upwardly to expose the operating mechanism for any desired maintenance or repair. It will also be apparent that leaves and other debris 92 which are carried out of the swimming pool 10 by the cover 16 will accumulate under the cover deck 84 and may be removed periodically.

A minor problem with the deck sections 90 is that they are somewhat flexible since they are cantileved passed the leftmost column 86 as viewed in FIG. 4. Accordingly, people may tend to jump up and down on the ends of the sections 90 as on a diving board. Diving boards are, of course, manufactured to provide resiliency without breaking while ordinary construction materials may deteriorate and fail under similar treatment. To obviate this difficulty, a metal reinforcing strap 94 may be nailed or otherwise secured to one or both edges of the deck sections 90. The deck sections 90 accordingly become substantially more rigid which not only prevents accidental breakage but which also discourages diving board type jumping thereon.

Figure 5:
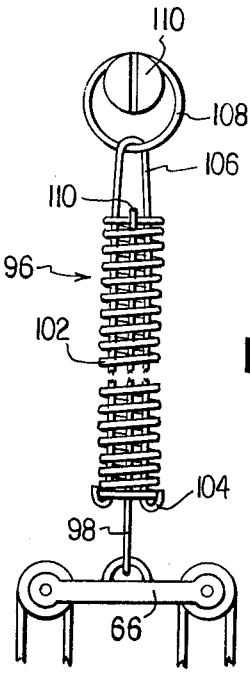
FIG. 5 is a view illustrating another type spring which may be used in the device of FIGS. 1–4.

Referring to FIG. 5 there is illustrated a compression spring 96 which is utilized in lieu of the tensile spring 68. The compression spring 98 is connected to the double pulley arrangement 66 by an elongate member 98 having a pair of hooked ends 100 which captivate one end of a helical compression spring 102. The opposite end of the compression spring 102 is captivated by a pair of hooked ends 104 formed on a generally U-shaped member 106 which is pinned to the walkway around the pool 10 in any suitable fashion, as by the use of an eye 108 and bolt 110.

Figure 6:
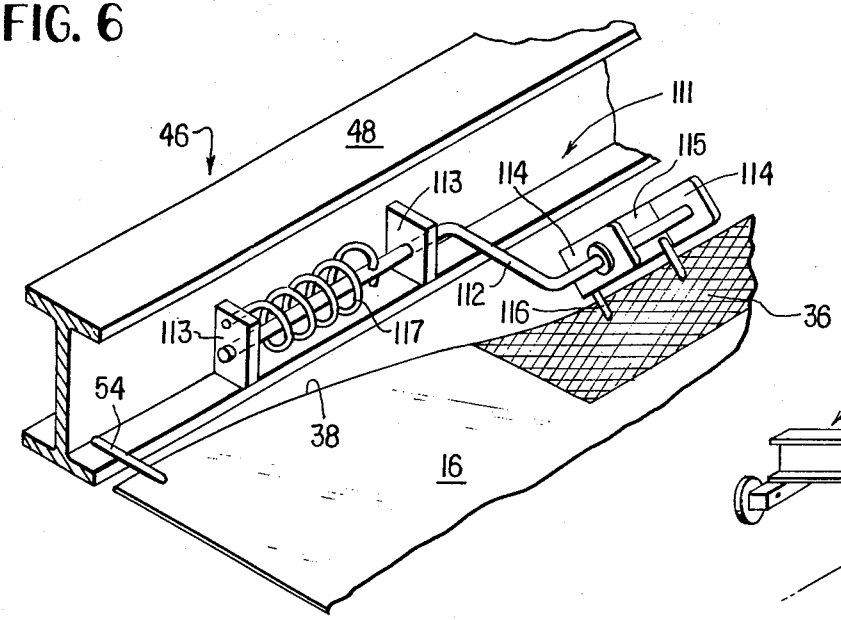
FIG. 6 is a partial isometric view illustrating a different mechanism for dumping rainwater off the cover.

Referring to FIG. 6 there is illustrated an alternative mechanism for raising and lowering the forward end of the cover in response to the weight of rainwater accumulated thereon. In lieu of the shock cord 56 there is provided a cover elevating mechanism 111 for normally maintaining the cover edge 38 and permeable section 36 above water level and allowing movement of the cover 16 toward the water in response to rainwater accumulated thereon. The mechanism 111 comprises an offset axle 112 having one end thereof journalled in a pair of brackets 113 carried by the beam 48 and the other end journalled in a pair of brackets 114. The brackets 114 are carried by a rigid swing bar 115 pivotally mounted on the free end 38 of the cover 16 by suitable shackles 116. A torsion spring 117 is mounted between one of the brackets 113 and the axle 112 for biasing the same in a direction lifting the cover 16 from the water. As will be apparent, the weight of rainwater accumulating on the cover 16 may overcome the bias of the spring 117 and allow the permeable section 36 to approach water level for draining off rainwater while retaining leaves on the cover 16. In areas where leaves are no problem, it will be apparent that the mechanism 111 may be designed to raise and lower the forward edge 38 of the cover 16 using a wholly impermeable sheet 16.

The provision of spooled swimming pool covers having means for guiding or laterally constraining the side edges of the cover is known in the art as shown in U.S. Pat. Nos. 2,898,607; 3,050,743 and 3,273,171. Also of interest is U.S. Pat. No. 1,957,994. One difficulty in guiding the cover sides resides in frictional losses in feeding the cover sides into a guide mechanism. Typically, the cover reel is disposed at a different elevation than the guides whereby the cover sides rub against the guide since feeding normally occurs at a modest acute angle. Another difficulty resides during cover spooling as the cover sides may tend to draw together due to uneven winding. The cover sides then come into contact with the guide mechanism in a lateral direction and create frictional losses.

Figure 7:
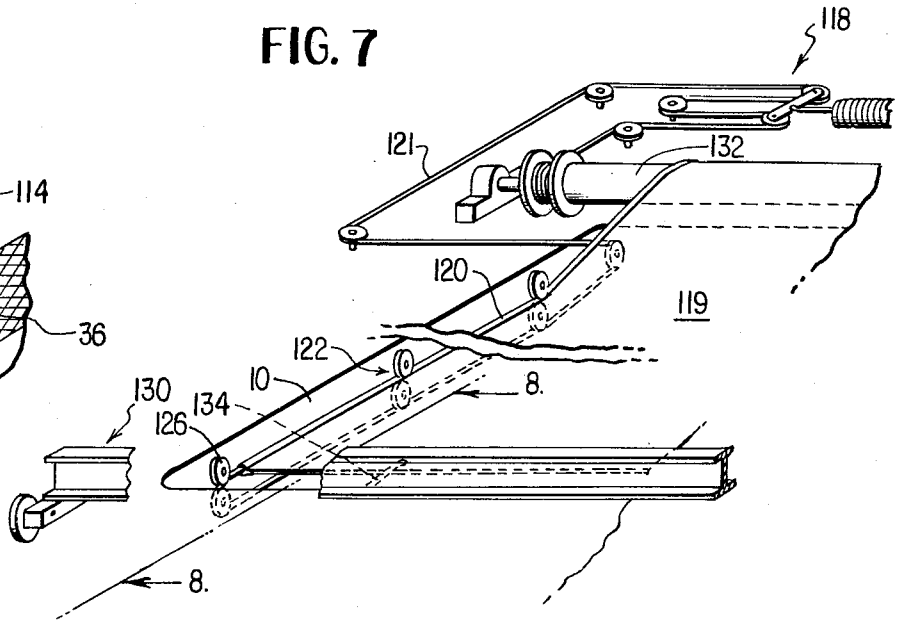
FIG. 7 is a partial isometric view illustrating a swimming pool cover of this invention incorporating a different cable path.
Figure 9:
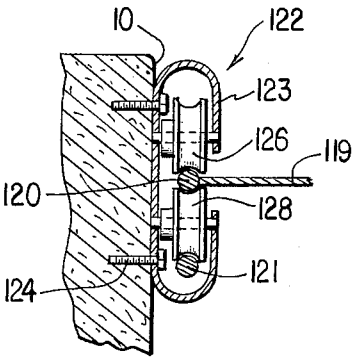
FIG. 9 is an enlarged cross-sectional view of FIG. 8 taken substantially along line 9–9 thereof as viewed in the direction indicated by the arrows.
Figure 8:
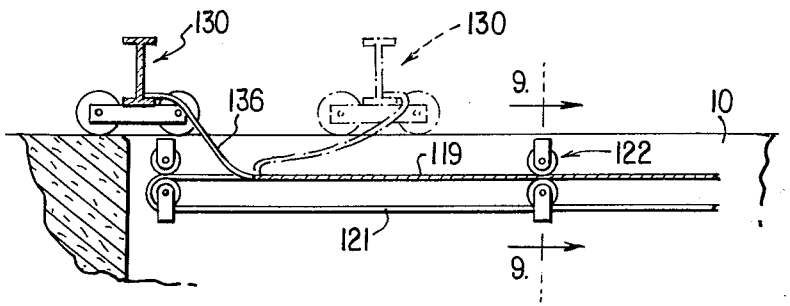
FIG. 8 is an enlarged cross-sectional view taken substantially along line 8–8 of FIG. 7.

Referring to FIGS. 7–9, there is illustrated a mechanized swimming pool cover 118 which differs in two respects from the mechanized cover 14. First, the sheet or cover 119 is provided with a beaded edge 120 as by looping the material of cover 119 around a rope 121 and stitching the same together. Thus, the cover 119 is reinforced in a manner similar to the webbing 32.

A second distinction between the mechanized swimming pool covers 14, 118 lies in the provision of twin pulley mechanisms 122 fastened to the swimming pool 10 as shown best in FIG. 9. The twin pulley mechanisms 122 comprise a housing 123 secured to the swimming pool 10 by suitable masonary anchors 124. Inside the housing 122 are a pair of pulleys 126, 128 mounted for rotation about parallel axes above and below the plane of the cover 119. The peripheries of the pulleys 126, 128 are spaced sufficiently far apart to receive the beaded edge 120 therebetween while the return leg of the rope 121 is threaded through the housing 122 adjacent the lower run of the pulley 128. It will accordingly be seen that cooperation of the beaded edge 120 with the pulleys 126, 128 provides a degree of lateral stability to the cover 119 which is absent in the embodiment of FIG. 1. Since the rope 121 is not directly connected to the trolley 130, there is some difference in operation between the mechanized swimming pool covers 14, 118. As can be seen best in FIGS. 7 and 8, retraction of the cover occurs when the sheet 119 is spooled onto the roller 132. Spooling of the cover 119 constitutes spooling of the beaded edge 120 and leftward movement of the rope 121 as viewed in FIG. 8. The trolley 130 is pulled along behind the cover 119 through one or more rigid connections 134, such as shackles or the like, and flexible elements 136.

During placement of the cover 119, the rope 121 is guided by the twin pulley arrangements 122 so that the beaded edge 120 of the cover 119 is guided in the path between the pulleys 126, 128. The twin pulley arrangements 122 accordingly define a path of movement of the cover 119. During placement of the cover 119, the trolley 130 is pulled along behind the leading edge of the cover as suggested by the phantom lines in FIG. 8. It will be apparent that the flexible elements 136 act simultaneously to pull the trolley 130 along the side of the pool 10 and also to keep the leading edge of the cover 119 from dipping into the water.

During retraction of the cover 119, the trolley 130 is pulled along behind the cover 119 as suggested in FIG. 8. In all other respects, the operation of the mechanized covers 14, 118 is substantially the same.

Figure 11:
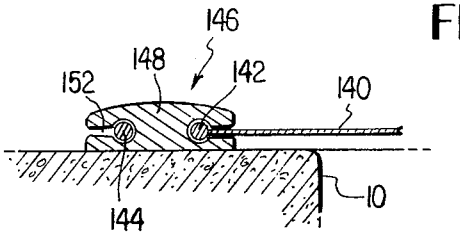
FIG. 11 is an enlarged cross-sectional view of FIG. 10 taken substantially along line 11–11 thereof as viewed in the direction indicated by the arrows.
Figure 12:
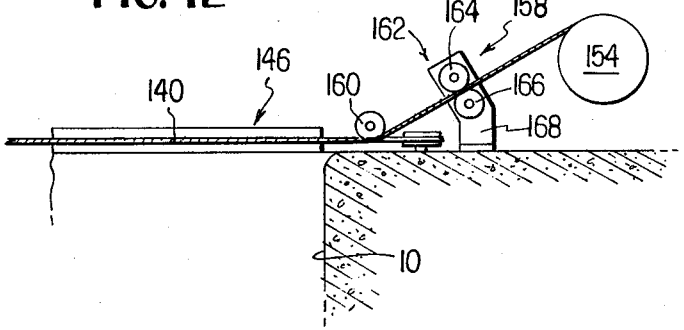
FIG. 12 is an enlarged cross-sectional view of FIG. 9 taken substantially along line 12–12 thereof as viewed in the direction indicated by the arrows.
Figure 10:
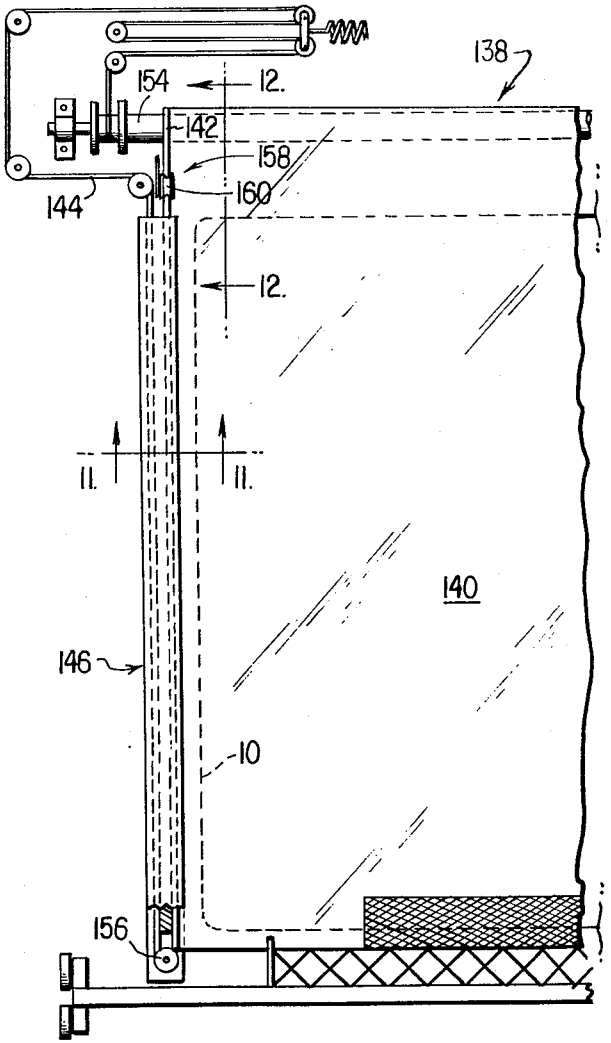
FIG. 10 is a partial view of another embodiment of the invention.

Referring to FIGS. 10–12, there is illustrated another embodiment 138 of the mechanized swimming pool cover of this invention. In most respects, the cover 138 is similar to the embodiment 118. For purposes of brevity, only those distinctions between them will be discussed. The mechanized cover 138 comprises a sheet or cover 140 having a pair of beaded edges 142 connected to a rope 144 which extend along the pool 10 and are hidden by a molding 146 shown best in FIG. 11. Referring to FIG. 11, the molding 146 comprises a base 148 which may be secured to the walkway around the pool 10 in any desired fashion. The molding 148 provides longitudinal slotted openings 150, 152 for receiving the beaded edge 142 and the rope 144. At the opposite end of the pool 10 from the cover reel 154 is a reversing pulley 156 disposed in a cutout in the molding 146.

As shown in FIGS. 10 and 12, a pulley arrangement 158 is disposed between the cover reel 154 and the molding 146. As shown best in FIG. 12, the pulley arrangement 158 comprises a single pulley 160 mounted above the cover 140 and positioned to alter the direction of cover movement from a downwardly inclined direction adjacent the reel 154 to a horizontal direction adjacent the molding 146. The beaded edge 142 of the cover 140 does not frictionally engage the molding 146 during placement and retraction of the cover 140. Since the beaded edge 142 and rope 144 are placed in substantial tension at all times, the edge 142 and rope 144 do not engage the molding 146 thereby reducing friction losses to that resulting from the pulleys 156, 160.

The pulley arrangement 158 also includes a double pulley arrangement 162 which is substantially identical to the arrangement 122. The arrangement 162 comprises first and second pulleys 164, 166 supported by a bracket 168 and positioned sufficiently far apart to receive the cover 140 and beaded edge 142 therebetween. As shown in FIG. 12, the pulleys 164, 166 may simply provide a restraint against lateral movement of the cover 140, or may accommodate part of the change of direction of the cover 140.

Figure 13:
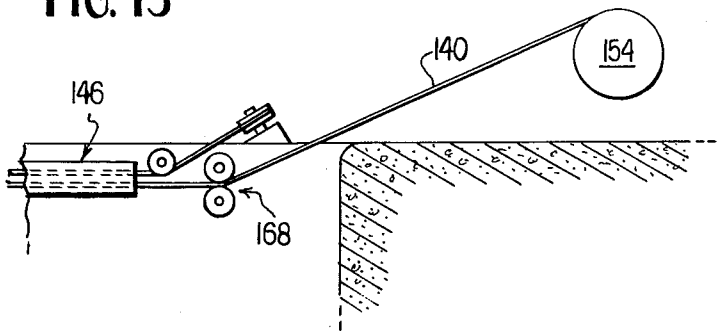
FIG. 13 is a view, similar to FIG. 12, of another device to guide the cable edge.

Referring to FIG. 13, there is illustrated another pulley arrangement 168 which is advantageously used when it is desired to position the cover 140 between the side walls of the pool 10 rather than to completely span the pool 10. In this embodiment, the molding 146 is placed vertically on the side wall of the pool 10 by suitable anchors. The pulley arrangement 168, which is substantially identical to the arrangement 122, is anchored on the sidewall of the pool 10 and acts to change the direction of travel of the cover 140 from downwardly inclined to substantially horizontal. There is accordingly no frictional loss or abrasion between the cover 140 and the molding 146.

I claim:

1. A swimming pool cover comprising a reel having a water-impermeable cover spooled thereon providing a water permeable section adjacent the free end thereof;

means operatively connected to the cover for spooling and unspooling the same across a swimming pool including a trolley above the surface of water in the pool for traversing the pool, means for moving the trolley, and attachment means connecting the trolley to the cover; and means for removing accumulated rainwater from the top of the cover in response to spooling movement while retaining debris thereon comprising means responsive to increased weight on the cover for moving the free cover end generally downwardly and placing the permeable section adjacent water level.

2. The swimming pool cover of claim 1 further comprising means responsive to decreased weight on the cover for moving the free cover end generally upwardly and spacing the permeable section above water level.

3. The swimming pool cover of claim 1 wherein the moving means comprises a flexible element securing the central portion of the free cover end to the trolley for relative movement therebetween, the flexible element having a minimum stretched length sufficient to place the permeable section adjacent water level.

4. A swimming pool cover comprising a reel having a water-impermeable cover spooled thereon providing a water permeable section adjacent the free end thereof;

means operatively connected to the cover for spooling and unspooling the same across a swimming pool including a trolley above the surface of the water in the pool for traversing the pool, means for moving the trolley, and attachment means connecting the trolley to the cover and comprising a rigid member connected to the trolley and to the cover adjacent the free end thereof; and means for moving accumulated rainwater from the top of the cover during spooling movement while retaining debris thereon comprising means responsive to increased weight on the cover for moving the free cover end generally downwardly and placing the permeable section adjacent the water level, the moving means comprising means normally biasing the rigid member upwardly.

5. The swimming pool cover of claim 4 wherein the rigid member comprises a first end journalled on the trolley about a first axis, a second end journalled on the free cover end about a second axis and an intermediate section joining the first and second ends and wherein the biasing means comprises a spring.

6. A swimming pool cover comprising a reel having a cover spooled thereon providing a free cover end;

means operatively connected to the cover for spooling and unspooling the same across a swimming pool and including a trolley for spanning the pool and traversing the same;

means for moving the trolley; and means attaching the cover to the trolley including first means securing the central portion of the free cover end to the trolley for relative movement therebetween throughout a predetermined range; and second means laterally of the first means for securing lateral portions of the free cover end to the trolley for substantially less movement therebetween than the predetermined range.

7. The swimming pool cover of claim 6 wherein the first means comprises a flexible element having a maximum unstretched length sufficient to maintain the free cover end above the surface of water in the pool during unspooling movement of the cover.

8. The swimming pool cover of claim 6 wherein the first means comprises a rigid member connected to the trolley and to the cover adjacent the free end thereof and means normally biasing the rigid member upwardly.

9. A swimming pool cover comprising a reel having a water-impermeable cover spooled thereon providing a free cover end;

means operatively connected to the cover for spooling and unspooling the same across a swimming pool including a trolley above the surface of water in the pool for traversing the pool, means for moving the trolley, and means connecting the trolley to the cover; and means for removing accumulated rainwater from the top of the cover at the completion of spooling movement including a rigid member and means mounting the member between the trolley and the cover for relative movement therebetween; and means normally biasing the rigid member and free cover end upwardly and for movement downwardly in response to accumulated rainwater on top of the cover.

10. The swimming pool cover of claim 9 wherein the rigid member comprises a first end journalled on the trolley about a first axis, a second end journalled on the free cover end about a second axis spaced from the first axis, and an intermediate section joining the first and second ends together, and wherein the biasing means comprises a spring.

11. The swimming pool cover of claim 10 wherein the spring comprises a torsion spring.

* * * * *